US006497436B1

(12) United States Patent
DeBlock et al.

(10) Patent No.: US 6,497,436 B1
(45) Date of Patent: Dec. 24, 2002

(54) THREE-PART MOTOR VEHICLE DOOR LOCK

(75) Inventors: Luc DeBlock, Sailly Flibeaucourt (FR); Jean Sannier, Buigny-l'Abbe (FR); José D'Almeida, Lamotte Buleux (FR)

(73) Assignee: Valeo Securite Habitacle, Creteil (FR)

( * ) Notice: Subject to any disclaimer, the term of this patent is extended or adjusted under 35 U.S.C. 154(b) by 0 days.

(21) Appl. No.: 09/505,108

(22) Filed: Feb. 16, 2000

(30) Foreign Application Priority Data

Feb. 16, 1999 (FR) ..... 99 01824

(51) Int. Cl.[7] ..... E05B 9/00
(52) U.S. Cl. ..... 292/216; 292/201; 292/DIG. 23
(58) Field of Search ..... 292/216, 201, 292/DIG. 23

(56) References Cited

U.S. PATENT DOCUMENTS

| | | | | |
|---|---|---|---|---|
| 4,995,654 | A | * | 2/1991 | Nishingmi et al. |
| 5,186,504 | A | | 2/1993 | Takaishi et al. |
| 5,975,596 | A | * | 11/1999 | Rogers, Jr. et al. |
| 6,240,752 | B1 | * | 6/2001 | Larsen et al. |

FOREIGN PATENT DOCUMENTS

| | | |
|---|---|---|
| EP | 103 904 | 3/1984 |
| EP | 894 924 | 2/1999 |
| FR | 2 656 030 | 6/1991 |
| GB | 2 156 422 | 10/1985 |
| GB | 2 178 475 | 2/1987 |
| GB | 2 212 848 | 8/1989 |
| GB | 2 321 494 | 7/1998 |

* cited by examiner

*Primary Examiner*—Anthony Knight
*Assistant Examiner*—Mark Williams
(74) *Attorney, Agent, or Firm*—Morgan & Finnegan, LLP

(57) ABSTRACT

The disclosure relates to a motor vehicle door lock characterized in that it includes a first module which includes a retention compartment containing the restraining parts of the lock, notably a striker-retaining latch-bolt and a pawl that holds said latch-bolt in at least one position restraining the striker, and in which part of the kinematic opening/locking chain of the lock is mounted on a mounting face of said first module, on the opposite side from said retention compartment; and that it also includes a second module on which is mounted the other part of the kinematic opening/locking chain of the lock, said second module fitting on said first module on the same side as said mounting face; and that it also includes a casing that covers said second module and the mounting face of said first module, said first and second modules and said casing being assembled by connecting means.

15 Claims, 11 Drawing Sheets

THREE-PART MOTOR VEHICLE DOOR LOCK

BACKGROUND OF THE INVENTION

The invention concerns a motor vehicle door lock with mechanical or electric control of opening and/or locking/unlocking.

DESCRIPTION OF THE PRIOR ART

In some known motor vehicle door locks, when the lock is in its locked state and an outside door handle is lifted before the unlocking information has been passed to the lock, the outside opening lever connected to the handle can block the unlocking mechanism, preventing opening of the lock. For example, in the case of such a lock with electric locking/unlocking, in a situation in which a passenger of the vehicle "panics" and tries to open a door by lifting the outside handle before the driver has been able to send a unlocking signal by means of his remote control, the electric lock motors unlock the locks in the other doors whose handles have not been touched, whereas the door whose handle is held in lifted position remains locked.

SUMMARY OF THE INVENTION

The prime purpose of the invention is to propose a motor vehicle door lock that provides an unlocking function of the lock even when a part of the lock blocks the lock's kinematic opening chain.

For this purpose, a first object of the invention is a motor vehicle door lock including an outside opening lever able to open the lock under the action of outside opening means such as a handle or outside door finger-plate, a locking lever able to move a disengageable interconnecting link between an engaged position in which the outside opening lever can cooperate, during its opening travel, with said interconnecting link to open the lock, and a disengaged position in which the opening travel of the outside opening lever does not interfere with said interconnecting link, which prevents opening of the lock, characterized in that it includes at least one blocking part able to block the movement of said interconnecting link when this link is in its disengaged position, and anti-panic means positioned between said locking lever and said interconnecting link to enable, on the one hand, movement of said interconnecting link by said locking lever, when said blocking part is at rest, and on the other hand, movement of said locking lever to its unlocked position when said blocking part is in its position blocking said interconnecting link, the unlocking energy resulting from the movement of the unlocking lever being stored by said anti-panic means to automatically trigger the movement of said interconnecting link to its engaged position as soon as said blocking part returns to its rest position.

In a particular embodiment, said anti-panic means include two distinct locking actuators whose respective movements are connected by elastic interconnection means, the first locking actuator cooperating with the locking lever and the second locking actuator cooperating with said interconnecting link, so that, on the one hand, the movement of the locking lever, when said part is at rest, causes movement of the interconnecting link via the two locking actuators, and on the other hand, the movement of the locking lever to its unlocked position, when said blocking part blocks the interconnecting link and the second locking actuator, causes both movement of the first locking actuator and elastic deformation of said elastic interconnection means which store the unlocking energy, the return of said blocking part to its rest position releasing the interconnecting link which then moves to its engaged position under the action of the second locking actuator moving under the elastic action of the elastic interconnection means.

The two locking actuators are preferably mounted pivoting on the same axis and are rotationally linked together by a torsion spring constituting said elastic interconnection means.

Advantageously, the outside opening lever constitutes a blocking part that can block the interconnecting link, said outside opening lever being able at the end of its opening travel to block said interconnecting link in its disengaged position.

According to another characteristic of the invention, the lock includes a superlocking lever cooperating with said anti-panic means, so as to block, in the superlocked position, the movement of the interconnecting link in its disengaged position, and to allow the movement of the locking lever to its unlocked position, said anti-panic means storing the unlocking energy resulting from the movement of the locking lever to automatically trigger the movement of said interconnecting link to its engaged position, when the superlocking lever returns to its rest position, said superlocking lever constituting a part that can block the interconnecting link.

In this case, one can arrange that the superlocking lever, in its superlocked position, is able to block the movement of said second locking actuator, so that the movement of the locking lever to its unlocked position causes both movement of said first locking actuator and elastic deformation of the elastic interconnection means, the return of the superlocking lever to its rest position releasing the second locking actuator which, under the elastic action of the elastic interconnection means, can move the interconnecting link to its engaged position.

Advantageously, the superlocking lever is able to block, in its superlocked position, the rotation of the second locking actuator to its unlocked position, whereas said second locking actuator is able to block, in its unlocked position, the movement of the superlocking lever to its superlocked position.

In a particular embodiment, the lock includes an electric superlocking control motor cooperating, via a gear train, with a toothed sector on the superlocking lever.

Advantageously, the locking lever cooperates with an inside locking lever, connected for example to a fascia pullrod, and with an electric locking/unlocking control motor via a gear train. For a front door lock, the locking lever also cooperates with an outside locking lever, connected for example to a lock barrel, the outside locking lever cooperating with the superlocking lever to move it to its rest position when the outside locking lever is moved to its unlocked position.

According to another characteristic, the interconnecting link cooperates with an inside opening lever such that, in the engaged position of said interconnecting link, the inside opening lever is able to cause the opening of the lock via the interconnecting link, and in the disengaged position of the interconnecting link, the opening travel of the inside opening lever does not interfere with said interconnecting link.

For the fabrication of motor vehicle door locks, it is common to make several separate modules or compartments that are then assembled to form the complete lock. These compartments or modules generally hold restraining parts, kinematic parts, and if need be electrical lock controls.

The second purpose of the invention is to propose a motor vehicle door lock which includes a new arrangement of the compartments or modules of the lock, to facilitate its final assembly and reduce the fabrication costs.

For this purpose, the second object of the invention is a motor vehicle door lock characterized in that it includes a first module which includes a retention compartment containing the restraining parts of the lock, notably a striker-retaining latch-bolt and a pawl that holds said latch-bolt in at least one position restraining the striker, and in which part of the kinematic opening/locking chain of the lock is mounted on a mounting face of said first module, on the opposite side from said retention compartment; and that it also includes a second module on which is mounted the other part of the kinematic opening/locking chain of the lock, said second module fitting on said first module on the same side as said mounting face; and that it also includes a casing that covers said second module and the mounting face of said first module, said first and second modules and said casing being assembled by connecting means.

The connecting means are advantageously constituted by at least two pins or shouldered screws that traverse successively a metal backplate of the first module, the body of the second module and the casing. In this case, one of the pins or shouldered screws can serve as an axis of articulation for an inside locking lever fitted on the second module and connected for example to a fascia pullrod.

One of the pins or shouldered screws could also serve as an axis of articulation for an inside opening lever on the second module.

In a particular embodiment, the first module includes a plastic case and a metal backplate which together define the retention compartment, the mounting face of the first module being defined by the bottom face of said case, on the opposite side from the retention compartment.

The second module preferably carries an inside opening lever that is connected to inside opening control means, for example a handle or an inside door finger-plate, a central locking lever, an inside locking lever that cooperates with said central locking lever and that is connected for example to a fascia pullrod, and an electric locking motor cooperating via a gear train with the central locking lever.

The second module also includes, for a front door lock, an outside locking lever that cooperates with said central locking lever and that is connected to a lock barrel.

In this case, the second module can also carry a superlocking lever and an electric superlocking motor cooperating via another gear train with the superlocking lever.

The second module can also include child-locking means cooperating with the inside opening lever, and an electric child-locking motor cooperating via another gear train with said child-locking means.

In a particular embodiment, the gear train of the electric locking control motor includes a worm on which is screwed a nut carrying two drive ears and a guide finger, said nut being able to translate to move the central locking lever through contact with one of the drive ears, in the locking or unlocking direction depending on the direction of travel of the nut, said guide finger forming a cam follower that engages in a cam groove in the mounting face of the first module, to tip over said nut from one drive ear to other at the end of the locking or unlocking travel.

The mounting face of the first module advantageously carries an outside opening lever that is connected to outside control means, for example a handle or an outside door finger-plate, an opening lever able to cooperate with the pawl, a transfer lever able to cooperate with an inside opening lever fitted on the second module, a disenageable interconnecting link which, in its engaged position, is able to connect rotationally the outside opening lever, the transfer lever and the opening lever, whereas when the interconnecting link is in its disengaged position, the opening travels of the outside opening lever and the transfer lever do not interfere with said interconnecting link.

The mounting face of the first module can also carry anti-panic means including two distinct locking actuators whose respective movements are connected by elastic interconnection means, the first locking actuator being intended to cooperate with a central locking lever of the second module, and the second locking actuator being connected to the interconnecting link, so that on the one hand, the movement of the central locking lever, when the outside opening lever is at rest, causes the movement of the interconnecting link, via the two locking actuators, and on the other hand, the movement of the central locking lever towards the unlocked position, when the outside opening lever is at the end of its opening travel, causes both movement of the first locking actuator and elastic deformation of the elastic interconnection means, the movement of the second locking actuator being blocked by the outside opening lever via the interconnecting link, the return of the outside opening lever to its rest position releasing the interconnecting link which then moves to its disengaged position under the action of the second locking actuator, which moves under the elastic action of the elastic interconnection means.

The first module advantageously includes, in its retention compartment, a feeler able to cooperate with a profile of the latch-bolt to indicate at least its opened position and its closed position, said feeler being rotationally attached to a contact part mounted on said mounting face. In this case, the second module can contain at least one contactor that cooperates with said contact part which traverses an arc-shaped guide slot penetrating the body of the second module. The contact part preferably includes at least one prong presenting an inclined ramp able to depress a push-button of the contactor during rotation of the feeler under the action of the pivoting of the latch-bolt between a position restraining the striker and a position releasing the striker.

The third purpose of the invention is to propose a motor vehicle door lock with improved provision for child-locking.

For this purpose, the third object of the invention is a motor vehicle door lock with child-locking means able to prevent opening of the lock by an inside opening lever, when inside control means are activated, for example a handle or an inside door finger-plate, said child-locking means including a control knob accessible outside the lock, notably when the vehicle door is open, and a child-locking actuator that can be moved by said control knob between a child-unlocked position and a child-locked position, wherein said door lock includes disenageable connecting means cooperating with said child-locking actuator and said inside opening lever, so that, in the child-unlocked position, said connecting means engage the connection between said inside opening lever and an intermediate opening lever cooperating with a restraining pawl of a lock striker, and in the child-locked position, the opening travel of said inside opening lever does not interfere with said child-locking actuator and said intermediate opening lever.

In a particular embodiment, said disenageable connecting means include a connecting pin positioned between said inside opening lever and said intermediate opening lever, so that, on the one hand, said connecting pin rotationally links said inside opening lever and said intermediate opening lever, when the connecting pin is moved by the child-locking actuator into the child-unlocked position and, on the other hand, said connecting pin can move freely relative to said intermediate opening lever and to said child-locking actuator, under the action of said inside opening lever when said connecting pin is moved by said child-locking actuator into the child-locked position.

In this case, the inside opening lever can include an elongated opening in which the connecting pin can slide between its child-locked and child-unlocked positions, said opening extending substantially radially relative to the axis of rotation of the inside opening lever to rotationally connect this lever with the connecting pin. The intermediate opening lever can include a substantially L-shaped opening, a first branch of the L coinciding with the elongated opening of the inside opening lever to allow sliding of the connecting pin between its child-locked and child-unlocked positions, while the second branch of the L allows movement of the connecting pin from its child-locked position, during the opening travel of the inside opening lever, the first branch extending substantially radially and the second branch extending substantially in a circular arc relative to the axis of rotation of the intermediate opening lever.

Advantageously, child-locking actuator cooperates via a gear train with an electric child-lock control motor which drives said child-locking actuator between the child-locked and child-unlocked positions. The child-locking actuator can be free to translate and include a nipple which moves in translation with a rack engaged by a cog driven by said electric locking control motor child.

According to another characteristic, child-locking actuator includes an elongated groove that coincides substantially with the second branch of the L-shaped opening in the intermediate opening lever and that engages said connecting pin, said groove being arranged so as to move the connecting pin between the child-locked and child-unlocked positions, but allowing free sliding of said connecting pin during the opening travel the inside opening lever.

The rack preferably cooperates with a contactor to indicate the child-locked or child-unlocked position.

According to another characteristic, the child-locking means and the inside opening lever are mounted on a module of the lock that is separate, before assembly, from another module containing the restraining parts of the lock.

In a particular embodiment, the child-locking actuator includes a boss cooperating with a flexible lever on a body of the lock, to define the two stable positions, child-locked and child-unlocked, of said child-locking actuator, on each side of said flexible lever, by elastic action of said boss on said flexible lever.

Obviously, the three objects of the invention defined previously can be taken separately or in combination with each other while remaining within the scope of the invention.

BRIEF DESCRIPTION OF THE DRAWINGS

Other characteristics and advantages of the invention will appear on reading the detailed description below of preferred embodiments, taken only as illustrative examples and in no way limitative, with reference to the attached drawings of which.

DETAILED DESCRIPTION OF PREFERRED EMBODIMENTS

Figure 19:
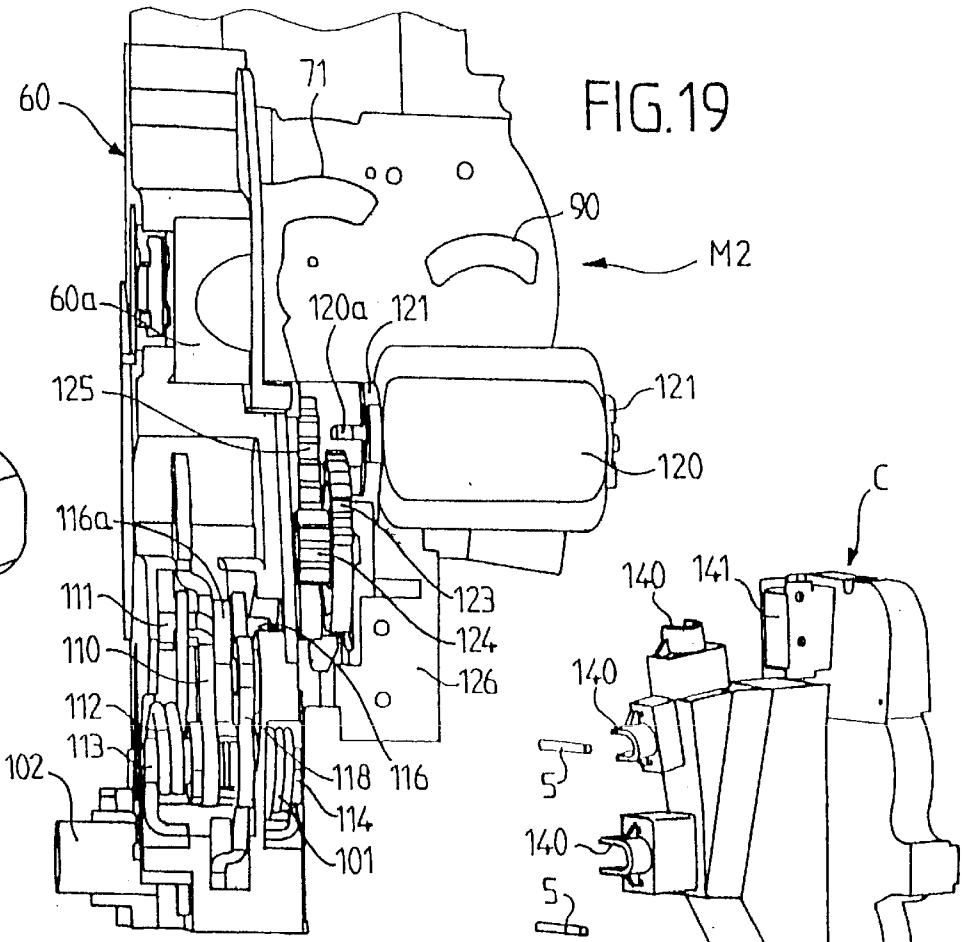
FIG. 19 is a view in the direction of the arrow XIX of FIG. 18, with the electric child lock control parts fitted on the second module.
Figure 20:
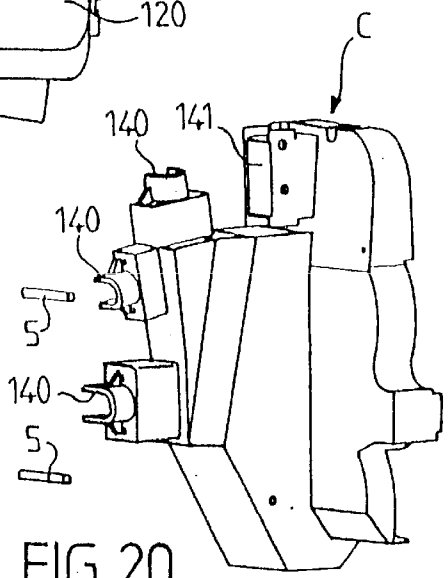
FIG. 20 is a perspective view of a casing of the lock according to the invention, before assembly with the other modules.

The lock according to the invention is constituted essentially of three parts, a first module referenced M1 (FIGS. 1 to 12), a second module referenced M2 (FIGS. 7 to 19), and a casing referenced C (FIG. 20). All these parts are shown assembled in FIG. 21.

The module M1 will now be described in detail. The module M1 includes a plastic case 1 and a metal backplate 2 which together define a retention compartment 3. The backplate 2 is substantially L-shaped; its smaller face ends with two tabs 4 which extend perpendicularly to the larger face of the backplate. These tabs 4 are drilled (4*a*) to receive the pins 5 seen in FIG. 20. At the end of the larger face of the backplate 2 there is a tab 6 bent at 90° to the face (this tab is better seen in FIGS. 4 to 6) to fit around the casing 1. This tab 6 is cut to form a tongue 6*a* which can be bent against a flat face 1*a* of the casing 1 during assembly of the backplate 2 on the casing 1. An cut-out 7 extends partially over the larger and smaller faces of the backplate 2 which allows for the passage of a striker generally fixed to the body of a vehicle. The larger face of the backplate 2 has three holes 8 intended to receive fastening screws to mount the lock on the edge of a vehicle door. The larger face of the backplate 2 has four other drillings 9 to 12 to receive respectively the spindle 13 of the pivoting latch-bolt 14, the spindle 15 of the pivoting pawl 16, the spindle 17 for pivoting lock opening parts, and the spindle 18 (see FIG. 3) of a pivoting latch-bolt feeler 19. A seal 20 is fitted around the edge of the part of the cut-out 7 extending along the smaller face of backplate 2. This seal 20, known as the lock throat seal, acts as a weather-strip between the lock and the door frame. This seal avoids infiltrations into the lock of water running in the gap that always exists between the vehicle body and the door. This rubber seal 20 can be molded with projecting nipples 20*a* intended to engage corresponding holes 2*a* along the edge of the cut-out 7 on the smaller face of backplate 2, to improving the holding of the seal on the backplate. In a variant, the rubber seal 20 could be molded on the case 1 instead of being fixed to the backplate. The backplate 2 can be fixed to the case 1 by riveting or by clipping, for example by means of a clip 21 on the backplate 2 that engages an edge of the casing 1.

In the bottom of the retention compartment 3 of the casing 1 there is a recess 22 forming the lock throat for the striker. The lock throat 22 includes a flexible flap 22*a* intended to lessen the shock of entry of the striker into the lock throat. A rubber striker wedge 23, with two sections substantially at right angles is fitted in the lock throat 22, with one of its sections beneath the flexible flap 22*a* so as to position the vertical position of the striker relative to the lock. In the bottom of the retention compartment 3 there are three holes 24 which align with the holes 8 in the backplate 2 and which receive fastening screws (not shown). In the bottom of the retention compartment 3 there are four additional holes 25 to 28 that align respectively with the drillings 9 to 12 in the backplate 2 and receive respectively the spindles 13, 15, 17 and 18. An substantially arc-shaped opening 29 penetrates the bottom of the retention compartment 3 to allow passage of a pin 30 of the pawl 16 (see FIG. 4). This pin 30 can be a separate part attached to the pawl 16 by crimping. In a variant, the pin 30 can be formed by pressing or stamping of the pawl 16, in which case the final height of the pin could be increased by applying a plastic coating to it. The hole receiving the spindle 15 of the pawl 16 can advantageously include a molded plastic cover to avoid a metal-to-metal contact that could result in noise. A return spring 31 is fitted on the spindle 15 of the pawl 16. One end of the spring 31 is in contact with the pin of the pawl, while the other end is in contact with on a part 1*b* on the case 1.

The latch-bolt 14 is of the fork type and plastic-covered. On one of the branches of the fork of the latch-bolt 14, two hooks 14*a*, 14*b*, stripped of plastic, engage a tooth 16*a* of the pawl 16. When the tooth 16*a* of the pawl 16 holds the hook 14*a* of the latch-bolt 14, the lock is in closed position, whereas when the tooth 16*a* cooperates with the hook 14*b* the lock is in mid-position or half-closed. The other branch of the fork of the latch-bolt 14 also includes two bare sections 14*c*, 14*d*. If the latch-bolt 14 is brought back, for example by hand, to a position where it is restrained by the pawl, when the door is open, and if the user then slams the door violently, the striker impacts the bare section 14*c* or 14*d* of the latch-bolt, which avoids any risk of breaking the plastic coating of the latch-bolt, which could result in operational problems due to rubbing of the plastic on the backplate.

On the side opposite its fork, the latch-bolt 14 has a bare cam-shaped projecting section 32 which cooperates with the feeler 19. This projecting section 32 has a cam profile 32*a* on one side and a bearing section 32*b* on the other, the latter being intended to come up against one of the fastening screws when the latch-bolt has previously been moved manually to its closed position. A return spring 33 is fitted on the spindle 13 of the latch-bolt 14. One end of the spring 33 is in contact with the bearing section 32*b* of the latch-bolt 14, while the other end fits in a slot 25*a* of the hole 25 (see FIG. 3).

Advantageously, the striker wedge 23 and the seal 20 are molded at the same time on the case 1.

The feeler 19 constitutes a cam follower intended to bear against the cam profile 32*a* of the latch-bolt 14. This feeler 19 pivots during rotation of the latch-bolt 14 to indicate the various positions (e.g. closed, semi-closed and open) of the latch-bolt 14. The feeler 19 is rotationally attached to the spindle 18. A return spring 34 is fitted on the spindle 18 to press the feeler 19 permanently against the cam profile 32*a* of the latch-bolt 14. The spindle 18 extends at the opposite side from the feeler 19, in the form of a fork 35 with two parallel prongs 35*a*, 35*b* whose functions will be explained later.

Figure 2:
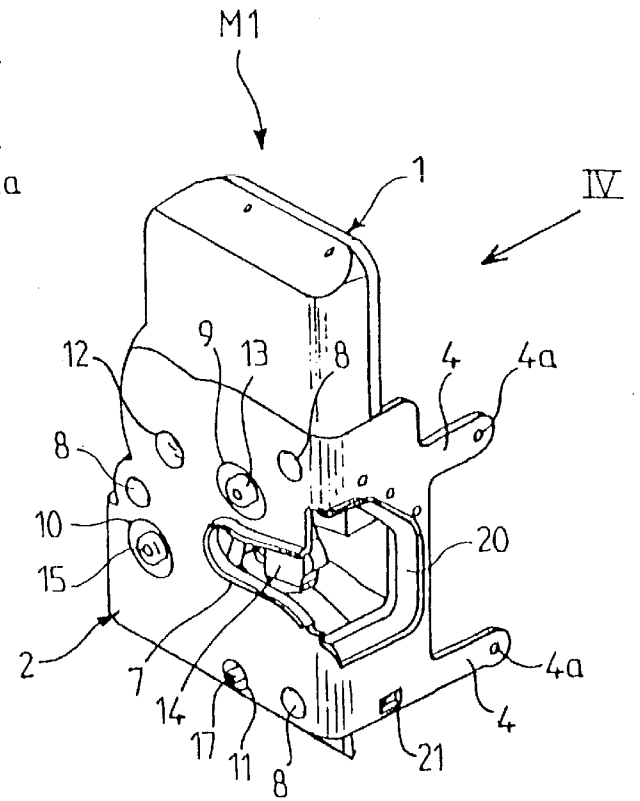
FIG. 2 is a view similar to FIG. 1, showing the first module assembled.
Figure 1:
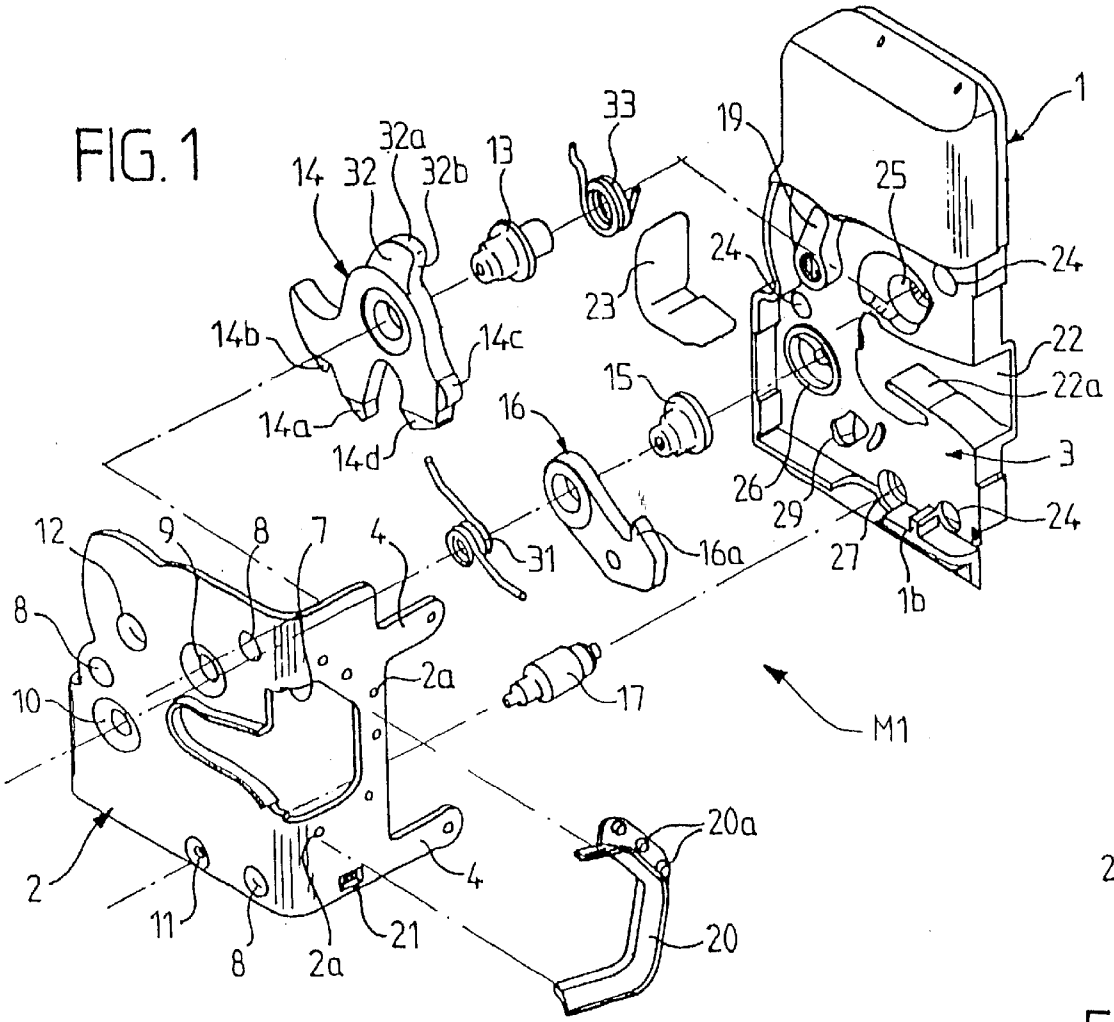
FIG. 1 is an exploded perspective view of the first module of the lock according to the invention, seen from the retention compartment side.
Figures 3, 4:
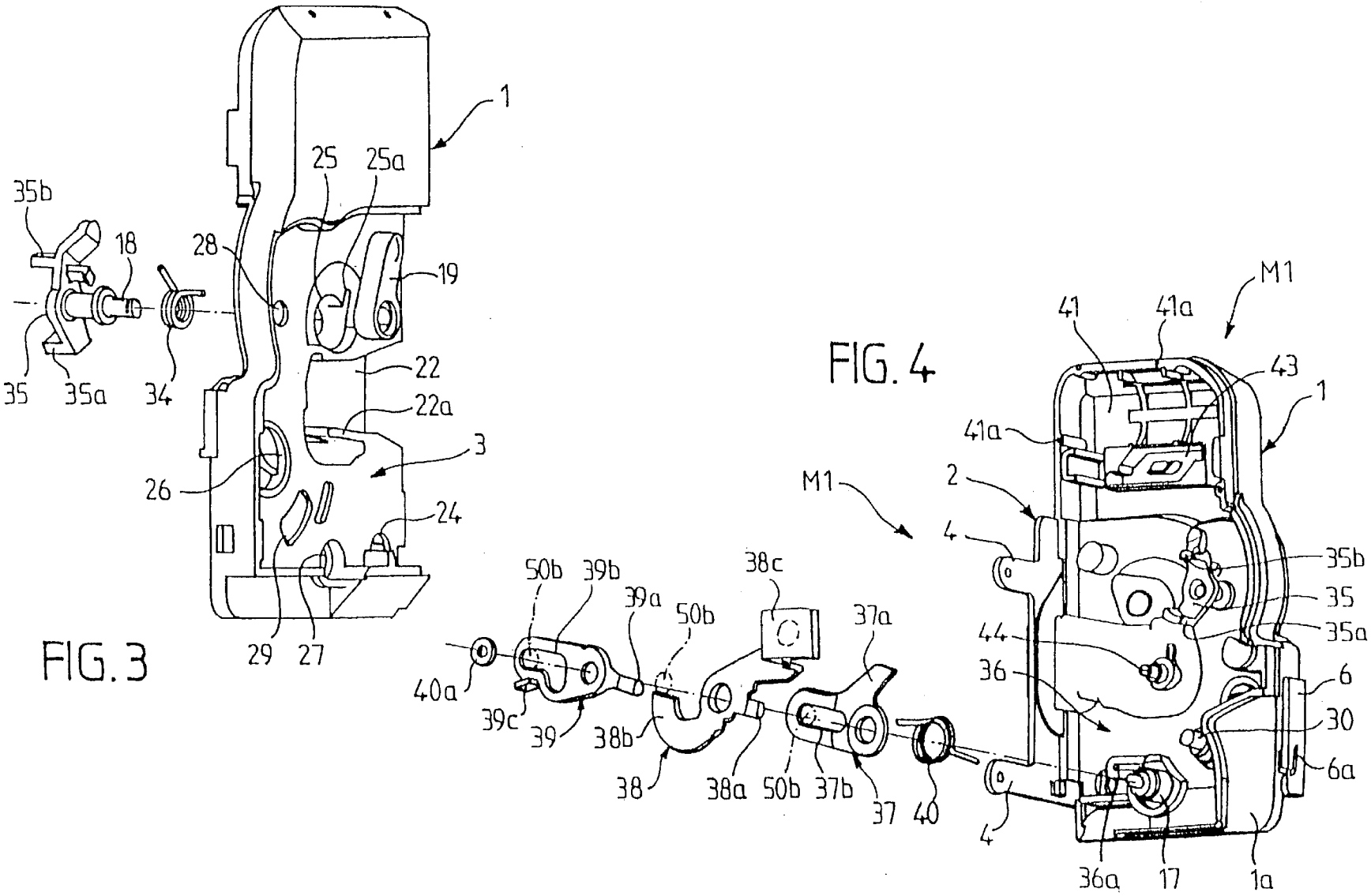
FIG. 3 is a perspective view of the case of the first module with the parts of the latch-bolt feeler exploded.
FIG. 4 is a perspective view in the direction of the arrow IV of FIG. 2, showing lock opening parts exploded before being fitting on the mounting face of the case of the first module.
Figure 6:
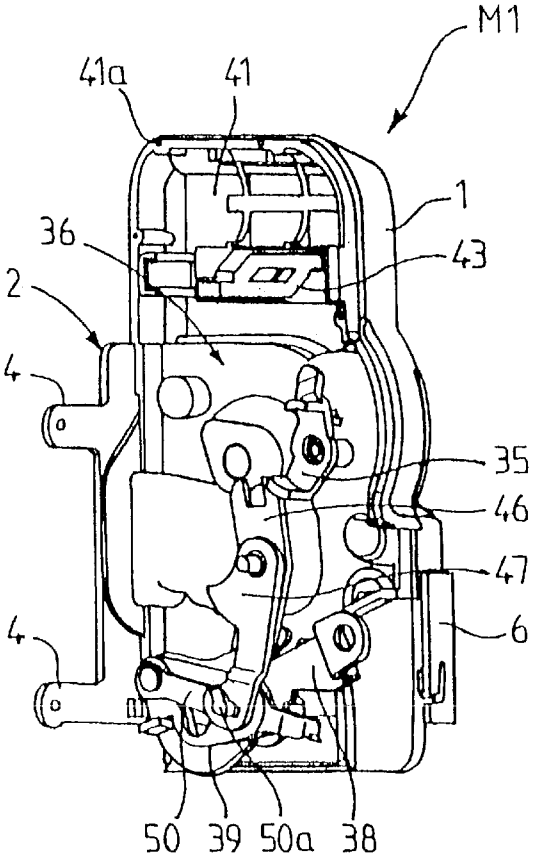
FIG. 6 shows the locking parts of FIG. 5 after fitting on the first module.
Figure 5:
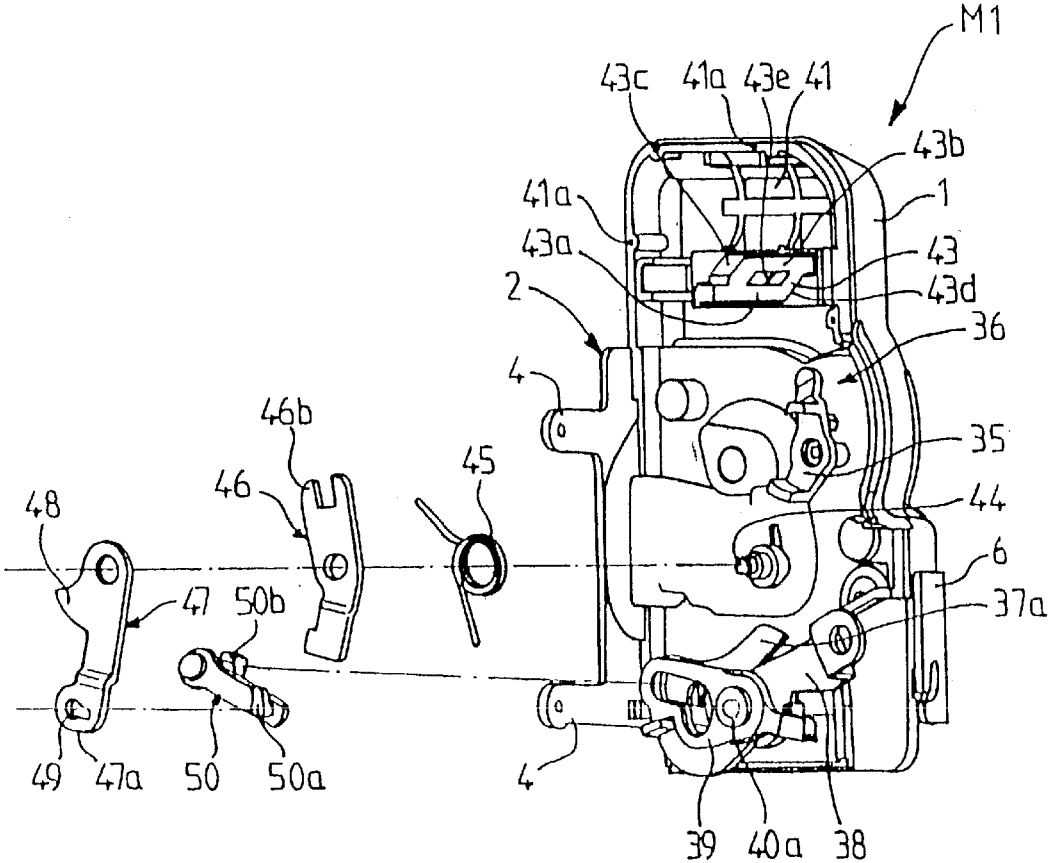
FIG. 5 shows the opening parts of FIG. 4 after fitting on the first module, with the locking parts exploded before being fitting on the mounting face of the case of the first module.
Figure 8:
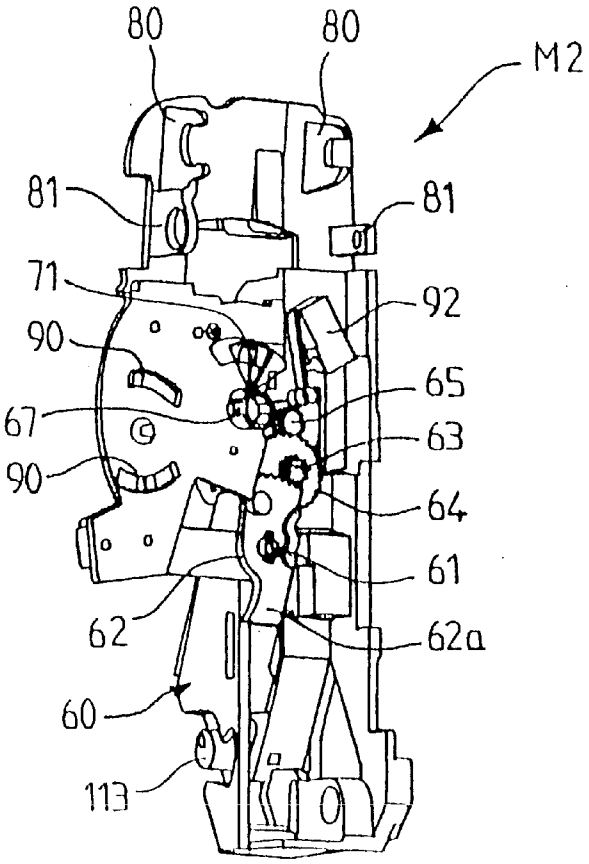
FIG. 8 is a view similar to FIG. 7, showing the superlocking parts fitted on the second module.
Figure 7:
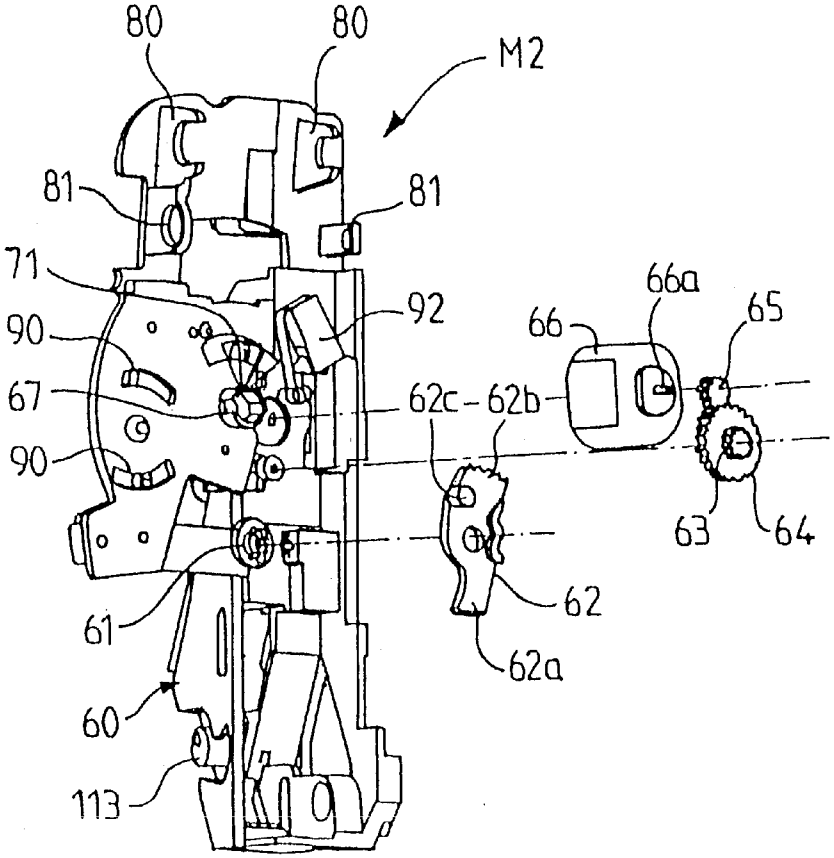
FIG. 7 is a perspective view of the body of the second module of the lock according to the invention, with the superlocking parts exploded.

Referring to FIGS. 4 to 6, on the mounting face 36 of the case 1 on the opposite side from the retention compartment 3, we see the fork 35, a projecting section of the pawl pin 30 and a projecting section of the spindle 17. On said projecting section of the spindle 17 are fitted successively a return spring 40, an opening control lever 37, an outside opening lever 38, a transfer lever 39, and a crimping washer 40*a*. One end of the spring 40 is engaged in a housing 36*a* on the mounting face 36 of the case 1; the other end bears against a tab 38*a* of the outside opening lever 38 bent perpendicular to the lever.

The opening control lever 37 includes a section 37*a* which cooperates with the pin 30 of the pawl 16, moving it between its position in which it restrains the latch-bolt and its position in which it releases the latch-bolt. An elongated opening 37*b* penetrates the opening control lever 37, substantially radially with respect to its axis of articulation.

A clip is fixed to one end 38*c* of the outside opening lever 38 to enable its connection to a control tie-rod, that is connected to a handle or an outside door finger-plate. The other end 38*b* of the opening lever 38 is curved substantially in the shape of hook or a U.

The transfer lever 39 also includes a tab 39*a* bent back downward to cooperate with the end of the spring 40. There is an opening 39*b*, substantially L-shaped, in the transfer lever 39. One of the branches of the L extends radially; the other extends over an arc of a circle around the axis of rotation of the lever 39. On the transfer lever 39 there is a second tab 39*c* folded upward, whose purpose will be explained later.

Figure 9:
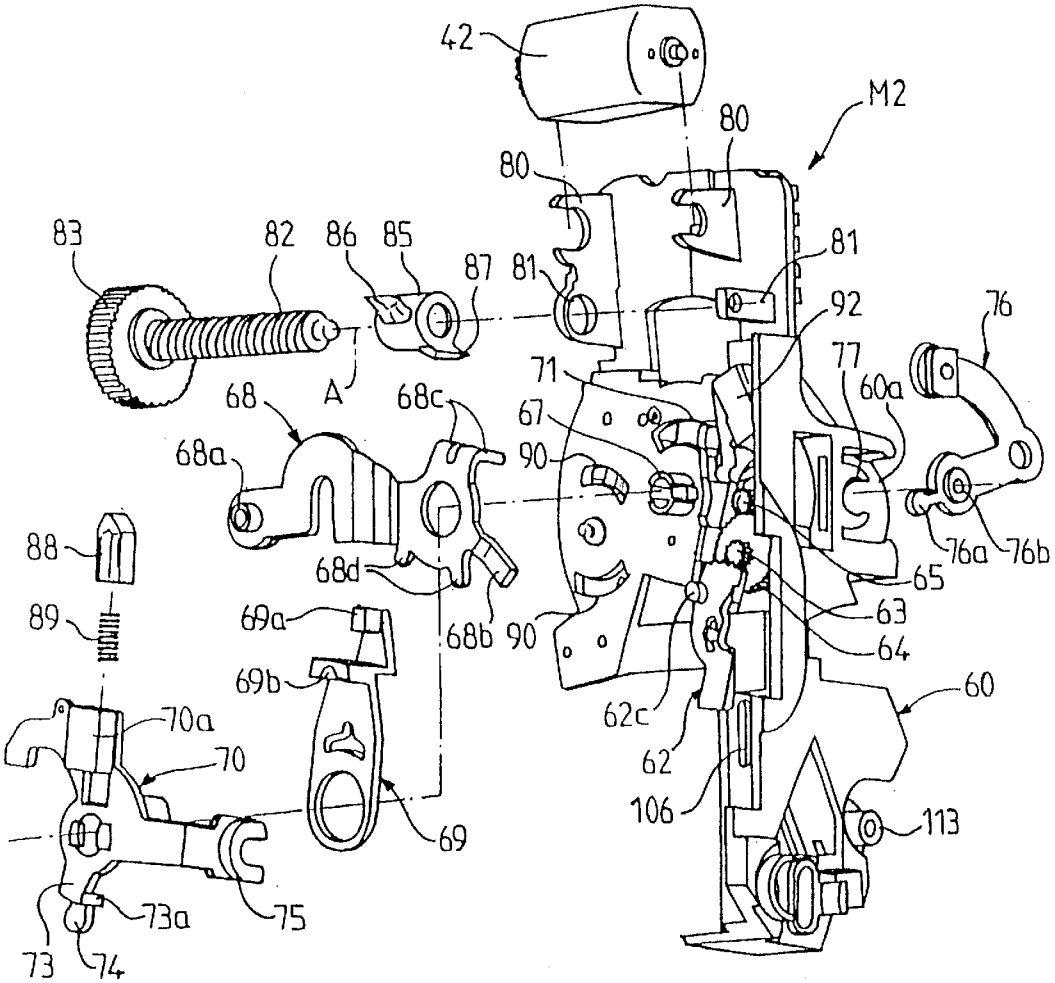
FIG. 9 is a perspective view similar to FIG. 8, but from a different angle, with the locking parts exploded, before fitting on the body of the second module.

The case 1 includes on its mounting face 36 a housing 41 to receive an electric locking/unlocking control motor 42 (see FIG. 9). The mounting face 36 also includes a cam groove 43, whose purpose will be explained later.

As seen in FIG. 5, the cam groove 43 includes a lower groove 43*a*, an upper groove 43*b* and two inclined ramps 43*c* and 43*d*. The mean lines of the two grooves 43*a*, 43*b* are rectilinear and substantially parallel to the axis A of the screw 82 fitted on the second module M2. The two grooves 43*a* and 43*b* are offset perpendicularly from this axis A. The ramp 43*c* joins the upper edge of the lower groove 43*a* at the upper edge of the upper groove 43*b*. The ramp 43*d* joins the lower edge of the lower groove 43*a* at the lower edge of the upper groove 43*b*. A projecting stud 43*e* is inserted between the ramps 43*c* and 43*d*; the thickness of this stud 43*e* corresponds to the gap between the two grooves 43*a* and 43*b*. The lower groove 43*a* extends beyond the ramp 43*c* to define the unlocking end-of-travel position of the lock, whereas the upper groove 43*b* extends beyond the ramp 43*d* to define the locking end-of-travel position.

The mounting face 36 of the case 1 also includes a molded projecting pin 44 on which are successively fitted, pivoting, an energy storage spring 45, a first locking actuator 46 and the second locking actuator 47. The two ends of the spring 45 bear respectively on a tab 46*a* folded upwards on the first locking actuator 46 and on the edge of the end section 47*a* of the second locking actuator 47 (see FIG. 22). The second locking actuator 47 also includes a tab 47*b* bent downward bearing against the first locking actuator 46, such that the two locking actuators are rotationally connect in the anti-clockwise direction. The first locking actuator 46 includes, at its end opposite the second locking actuator 47, a fork 46*b*, whose purpose will be explained later. The second locking actuator 47 includes a projecting section in the form of an angular sector 48, whose purpose will be explained later. The end section 47*a* of the second locking actuator 47 includes an aperture 49, which is shaped so as to enable the assembly with an interconnecting link 50, by means of a quarter-turn stud 50*a*. The aperture 49 has a circular profile which is prolonged radially by an rectangular section of width less than the diameter of the circular section. The stud 50*a* has a circular section corresponding to that of the aperture 49; at its end there is a boss of radial orientation whose shape corresponds to the rectangular section of the aperture 49.

The stud 50*a* projects above the interconnecting link 50, at one end of this link, and another similar stud 50*b* projects above the interconnecting link 50 at its opposite end. The stud 50*b* of the interconnecting link 50 is inserted successively through the L-shaped opening 39*b* of the transfer lever 39 and the elongated opening 37*b* of the opening control lever 37. The radial bosses of the studs 50*a* and 50*b* are turned angularly through about 90° to prevent the interconnecting link 50 detaching from the control levers 37, 39 and the second locking actuator 47, during assembly and operation of the lock. In the unlocked position of the lock, the stud 50*b* is located opposite the free end of the U-shaped section 38*b* of the outside opening lever 38 (see the dot-dash line in FIG. 4).

The mounting face 36 of the case 1 includes, on its upper peripheral edge surrounding the housing 41, a U-shaped seal (not shown). In a variant, this U-shaped seal can be molded on the case 1 at the same time as the seal 20 in the lock throat and the striker wedge 23 at the end of the lock throat. On this peripheral edge, there are several holes 41*a* intended to receive studs on the casing C, these studs then being fastened in the holes 41*a* by riveting or ultrasound welding.

The second module M2 of the lock according to the invention will now be described with reference to FIGS. 7 to 19.

Figure 12:
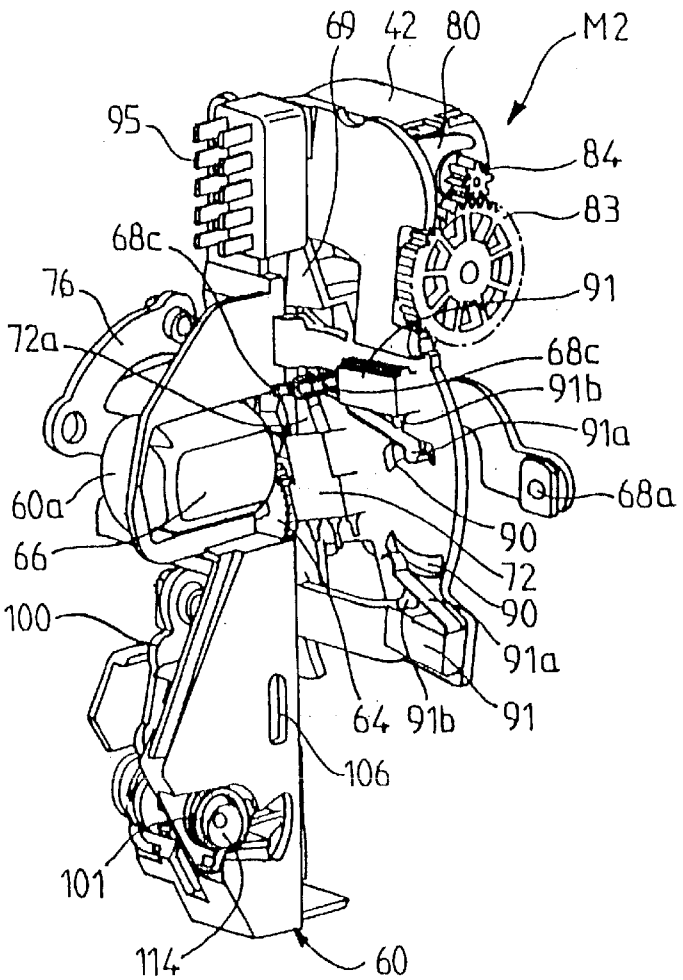
FIG. 12 is a view similar to FIG. 11, with the inside opening lever fitted on the second module.

The second module M2 includes a plastic molded body 60 whose lower face is seen in FIGS. 7 to 10 and 16 to 19, this lower face being intended to come into contact with the mounting face 36 of the case 1. The body 60 includes on the lower face an spindle 61 provided with a clip to support a superlocking lever 62. The superlocking lever 62 includes a section 62*a* intended to cooperate with the projection in the form of an angular sector 48 of the second locking actuator 47, on the first module M1 (FIGS. 22 to 26). The other section of the superlocking lever 62 includes, at its free end, a toothed sector 62*b* which engages a cog 63, rotationally attached to a cog 64 of greater diameter, this cog 64 engaging a second cog 65, rotationally attached to the output shaft 66*a* of an electric superlocking motor 66, the motor 66 and the gears 63 to 65 being fitted on the body 60 of the second module M2. The superlocking lever 62 carries a stud 62*c* projecting towards the mounting face 36 of the first module M1. This stud 62*c* is intended to provide for back-up unlocking of the superlocking lever in the event of battery failure, as explained later. As seen in FIGS. 11 and 12, the motor 66 is fitted on the upper face of the body 60, the drive shaft 66*a* traversing the body 60, while the motor unit 66 is held in a housing 60*a* projecting towards the top of the module M2.

Figure 10:
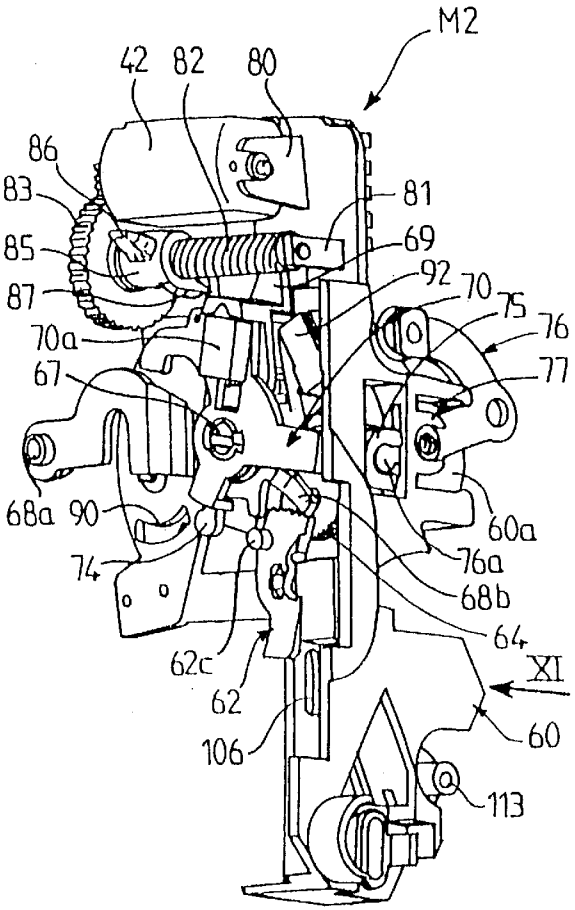
FIG. 10 is a view similar to FIG. 9, but with the locking parts fitted on the second module.
Figure 11:
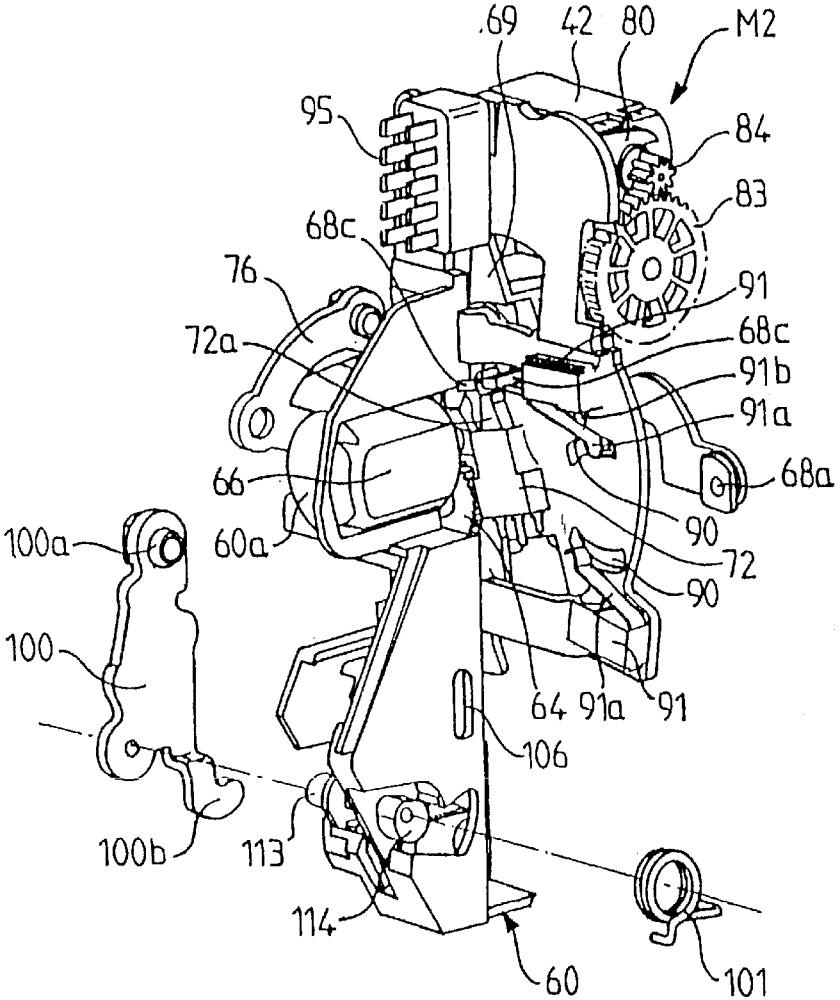
FIG. 11 is a perspective view of the second module, in the direction of the arrow XI of FIG. 10, with an inside opening lever exploded, for a front door lock.
Figure 17:
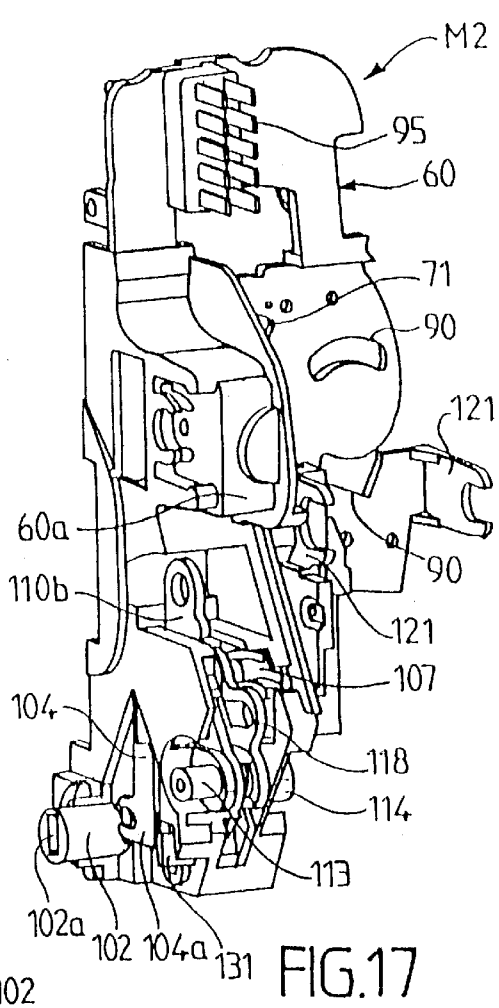
FIG. 17 is a perspective view of the second module, in the direction of the arrow XVII of FIG. 16, showing the parts of FIG. 15 fitted on the second module.

Referring to FIGS. 9 and 10, we see that the lower face of the body 60 includes the second axis equipped with a clip 67 to successively attach, pivoting, an outside locking lever 68, an intermediate locking lever 69 and a central locking lever 70.

Figure 21:
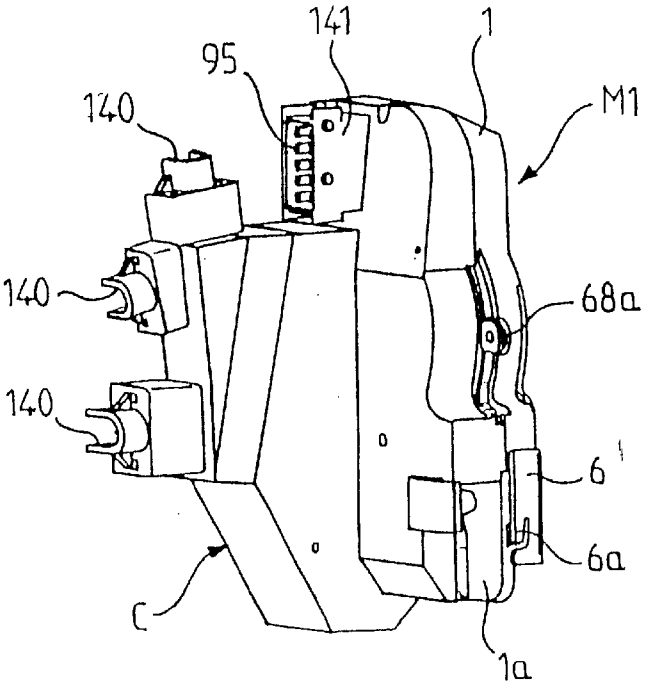
FIG. 21 is a perspective view of the fully assembled lock according to the invention.

The outside locking lever 68 includes a section of which the free end 68*a* is connected to a lock barrel, for a front vehicle door. As seen in FIG. 21, the end 68*a* projects outside the casing C to make its connection with the lock barrel. The outside locking lever 68 includes a tab 68*b* intended to cooperate with the tab 62*c* of the superlocking lever 62, in order to override the superlocking when the lock is unlocked using the lock barrel (not shown) in the event of electrical failure for example. The outside locking ever 68 carries a pair of tongues 68*c* of radial orientation folded upward and traversing a circular arc-shaped aperture 71 in the body 60, so that these folded tongues 68*c* extend beyond the upper surface of the body 60 (see FIGS. 11 and 12). Between the tongues 68*c*, is inserted a pivoting stalk 72*a* of a contactor 72 for detection of the position of the lock barrel. The locking lever 68 includes two fingers 68*d* spaced angularly and extending radially from the axis of the pivoting control lever, these fingers 68*d* being intended to cooperate with the central locking lever 70.

For this purpose, the central locking lever 70 includes a section 73 whose free end 73*a* is folded at 900 towards the lower face of the body 60 to fit with an angular clearance between the fingers 68*d* of the outside locking lever 68.

The folded end section 73*a* is prolonged at a right angle by a droplet-shaped nipple 74 which is intended to fit between the fingers of the fork 46*b* of the second locking actuator 46 of the first module M1. The central locking lever 70 includes another radial section folded at 90° whose free end is in the form of a fork 75. The fork 75 traverses the bottom of the body 60, as seen in FIG. 10. Between the fingers of the fork 75 is inserted a droplet-shaped nipple 76*a* of an inside locking lever 76. This inside locking lever 76 is substantially V-shaped and is articulated on a lateral wall of the body 60, at the free end 76*b* of one of the sections of the V. The droplet-shaped nipple 76*a* extends from the end 76*b*. This free end 76*b* includes a projecting stud intended to engage in a clip 77 on a lateral wall of the body 60. The inside locking lever 76 can be connected at the base of the V to a front door fascia pullrod. In this case, the front door fascia pullrod acts on the inside locking lever 76 in the vertical direction in FIG. 10. For a rear door, the fascia pullrod is connected to the free end of the other section of the V, the rear fascia pullrod acting on the inside locking lever in a horizontal direction in FIG. 10.

The body 60 also includes on its lower face two projecting tabs 80 serving as a bearing for the electric motor 42. Two other projecting tabs 81 provide a bearing for a worm 82 extending parallel to the motor 42. The worm 82 is coaxially attached to a cog 83 which engages a motor pinion 84, as seen in FIGS. 11 and 12. The worm 82 carries a nut 85 which includes a guide finger 86 projecting in the direction of the case 1, so as to engage in the cam groove 43 mentioned earlier. On the opposite side from the finger 86, the nut 85 carries two projecting ears 87 (only one of them is visible in FIGS. 9 and 10), these ears being offset angularly and mounted at the opposite longitudinal ends of the nut 85, such that the ears 87 can come alternatively into contact with a stud 69*a* on the intermediate locking lever 69. The finger 86 projects perpendicularly to an axial plane of the nut and the ears 87 project on the other side of this plane. During locking travel of the nut 85, one of the ears 87 comes into contact with the stud 69*a*, whereas during unlocking travel of the nut in the opposite direction, it is the other ear 87 that makes contact with this stud 69*a*. The intermediate locking lever 69 includes a notch 69*b* which can engage a pointed pawl pin 88 that can slide in a housing 70*a* of the central locking lever 70. The pawl pin 88 presses on a spring 89 in the housing 70*a* which pushes the pin towards the notch 69*b* on the intermediate locking lever 69. The operation of the tipping nut 85 is described in detail in the European patent no. 433 103, and will now be described briefly here.

When the lock is in unlocked position, the finger 86 of the nut 85 is located at the right end of the upper groove 43*b*; the ear 87 of the nut 85 is located opposite the stud 69*a* of the intermediate locking lever 69 (in FIG. 10, for reasons of clarity the control lever 69 is shown separated from the ear 87, whereas in reality the control lever 69 is near the ear 87). When the locking of the lock is ordered electrically, for example using an infrared controller, the electric motor 42 is started. This reversible motor 42 rotates the motor pinion 84 and this rotational movement is passed to the worm screw 82 via the cog 83. The rotation of the screw 82 draws the nut 85 towards the left, parallel to the axis A. The ear 87 of the nut 85 encounters the stud 69*a* of the intermediate control lever 69. The translation of the nut 85, via the ear 87, pushes the intermediate control lever 69 which pivots about its axis 67. The rotation of the intermediate control lever 69 causes the simultaneous rotation of the central locking lever 70, since these two levers are joined by the pawl pin 88 which is engaged in the notch 69*b* of the intermediate control lever 69. During the translation of the nut 85, the finger 86 follows the upper edge of the upper groove 43*b*. When the finger 86 reaches the left end of the upper groove 43*b*, the central locking lever 70 has undergone the rotation necessary to bring the lock to its locked configuration.

Next, the finger 86 moves along the ramp 43*c*, causing the nut 85 to turn over, allowing the stud 69*a* to escape from the ear 87. However, the central locking lever 70 cannot rotate any further since it is held in its locked position by the inside locking lever 76 connected to the fascia pullrod. Consequently, the intermediate control lever 69 disconnects itself rotationally from the central locking lever 70, the pawl pin 88 being pushed back into its housing 70*a* against the spring 89, allowing a slight additional rotation of the intermediate control lever 69. As soon as the first ear escapes from the stud 69*a*, the intermediate control lever 69 returns to its position of alignment with the central locking lever 70, under the action of the spring 89 which pushes the pawl pin 88 into the notch 69*b*. When the finger 86 of the nut 85 arrives at the bottom end of the ramp 43*c*, it penetrates into the lower groove 43*a*. In this position, the other ear 87 of the nut 85 finds itself opposite the stud 69*a*.

Next, the finger 86 moves parallel to the axis A until the left-hand end of the lower groove 43*a*.

When the locking of the lock is cancelled by an electric command, the nut 85 makes a movement in the opposite direction to the one described previously: the electric motor 42 rotates the pinion 84 in the opposite direction to the locking direction, thereby rotating the cog 83 and moving the worm screw 82 this time to the right. The nut 85 therefore moves towards the right parallel to the axis A, along the lower edge of the lower groove 43*a*. During the translation of the nut 85 the other ear 87 makes contact with the other side of the stud 69*a* of the intermediate control lever 69, causing a rotation in the direction opposite to the locking direction of this lever 69 and therefore of the central locking lever 70. When the finger 86 arrives at the right end of the lower groove 43*a*, the central locking lever 70 finds itself in its unlocked position.

Next, the finger 86 of the nut 85 follows the ramp 43*d* causing the nut 85 to turn over and releasing the stud 69*a* from the ear 87. However, since the central locking lever 70 can not rotate any further, the intermediate control lever 69 disconnects itself rotationally from the central locking lever 70, by pushing back the pawl pin 88 into its housing 70*a*, until the ear 87 escapes from the stud 69*a*. As soon as the ear 87 escaped from the stud 69*a*, the intermediate control lever 69 returns to its initial position under the action of the spring 89 which pushes the pawl pin 88 into the notch 69*b* of the intermediate control lever 69.

Finally, the finger 86 arrives at the top of the ramp 43*d* and enters the upper groove 43*b*, which brings the first ear 87 opposite the stud 69*a*. The nut 85 finishes its translation movement at the right-hand end of the upper groove 43*b*, with the ear 87 slightly separated from the stud 69*a*.

The body 60 of the second module M2 includes two circular arc-shaped slots 90 that are traversed by the prongs 35*a*, 35*b* of the fork 35 of the feeler 19 (see FIGS. 7 to 12). In a variant, a single circular arc-shaped slot 90 could be used when the latch-bolt has a single locking notch, in which case the fork 35 has only one prong. Referring to FIGS. 11 and 12, we see that a contactor 91 is placed on the upper face of the module M2, opposite each slot 90. Each contactor 91 has a flexible metal lever 91*a* that can be moved by a prong of the fork 35 and thereby depress a push-button 91*b* of the contactor 91. In a variant, there are no metal levers 91*a* since the prongs of the fork 35 act directly on the push-buttons of the contactors 91. In this case, the prongs of the fork 35 have a cam-shaped profile so that they depress the push-button 91*b* when the latch-bolt pivots into its opening position. In practice, this pivoting of the latch-bolt towards the opening position is relatively progressive as the door is opened and the door's weather-strip decompresses, so there is no risk of damage of the push-button by the prong of the fork. Inversely, the pivoting of the latch-bolt into its closed position can be relatively fast and violent when the door is slammed. However, there is little risk of damaging the contactor because, in this case, the fork prong is moving away from the contactor's push-button to release it.

Another contactor 92 that detects the position of the fascia pullrod is placed on the lower face of the body 60 (see FIGS. 7 to 10). This contactor 92 can also include a flexible lever acting on a push-button. The flexible lever of the contactor 92 is intended to cooperate with the section of the central locking lever 70 which carries the fork 75, as seen more clearly in FIG. 9.

As seen more clearly in FIGS. 11, 12 and 17, 18, the upper face of the module M2 includes electrical connection pins 95 for the motor 42.

Referring to FIGS. 11 and 12, we see an inside opening lever 100 of which one end 100*a* of one section is connected to inside opening control means, for example a handle or an inside front door finger-plate. The inside opening lever 100 also has a tab 100*b* bent downwards and traversing the bottom of the body 60 of the module M2 to be able to cooperate with the tab 39*c* of the transfer lever 39 of the first module M1. A return spring 101, with one end which bears on the body 60 and another end that bears on said tab 100*b*, pushes the inside opening lever 100 to its rest position.

FIGS. 13 to 19 show another variant of the embodiment of the lock according to the invention, in which child-locking means are included in the second module M2.

Figure 16:
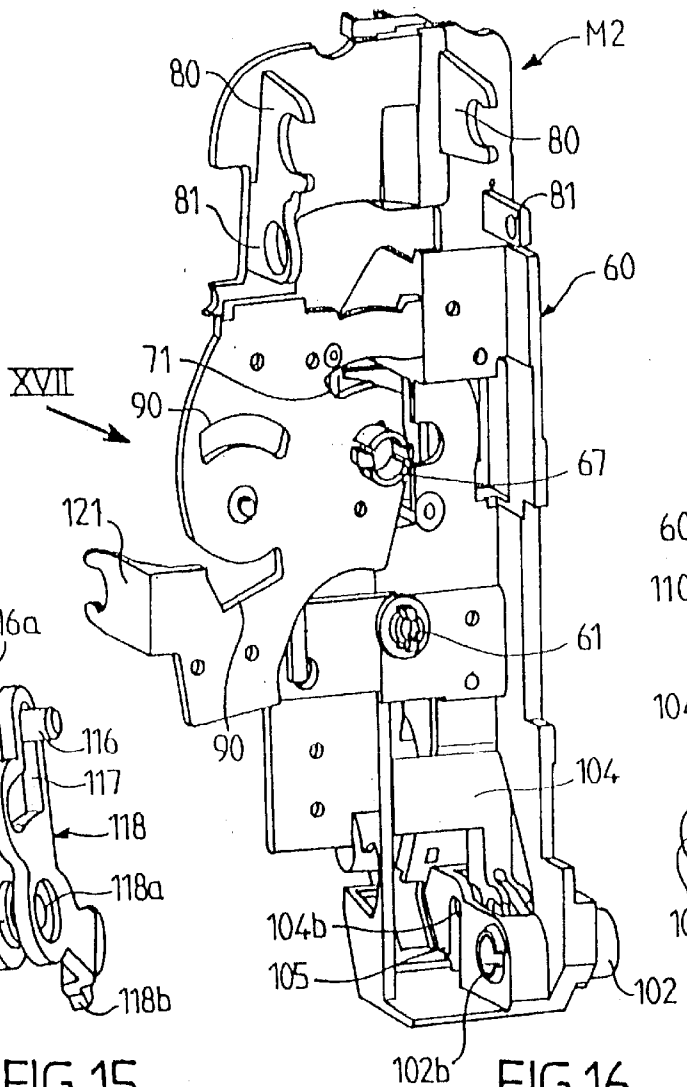
FIG. 16 is a perspective view of the body of the second module similar to FIG. 7, with the child-locking means of FIG. 13 fitted on the second module.
Figure 13:
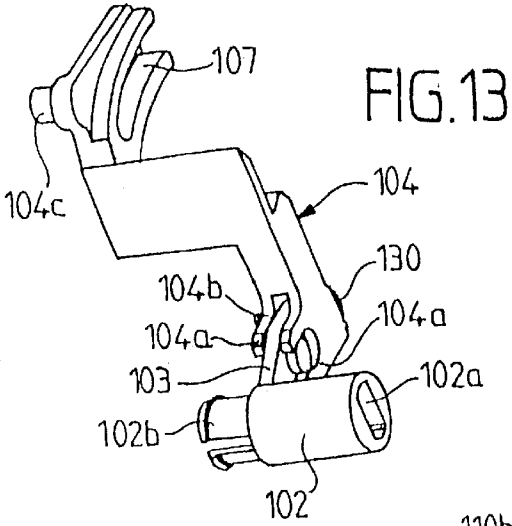
FIG. 13 is a perspective view of the child-locking means for a rear door lock.

The child-locking means include a rotary knob 102 one end of which includes a slot 102*a* to receive a key. The other end of the knob is equipped with a clip 102*b* used to fasten it to the body 60 of the module M2. The rotary knob 102 includes a radially projecting plate 103 which is articulated between a pair of forks 104*a* of a child lock lever 104. One of the forks 104*a* of the child lock lever 104 includes a guide lug 104*b*, which slides in a longitudinal slot 105 in the body 60 (FIG. 16). At the end opposite the forks 104*a*, the child lock lever 104 includes a second guide lug 104*c* which is intended to slide in a longitudinal slot 106 in the body 60 (FIGS. 11 and 12). Near the guide lug 104*c*, the child lock lever 104 includes a circular arc-shaped groove 107 of substantially U-shape.

An inside opening lever 110 is articulated at one end 110*a* on the body 60 and is connected at its opposite end 110*b* to inside opening control means, for example a rear door inside handle or finger-plate. The inside opening lever 110 includes a tab 111 against which presses one end of a return spring 112. The spring 112 and the spring 101 mentioned earlier are fitted respectively on spindles 113, 114 on the body 60. As seen more clearly in FIG. 14, the inside opening lever 110 includes an elongated opening 115 in which slides an intermediate opening pin 116. This intermediate opening pin 116 also engages in a substantially L-shaped opening 117 in an intermediate opening lever 118. The pin 116 includes a central section 116*a* of greater diameter which is inserted between the control levers 110 and 118. One of the sections of the L-shaped opening 117 is aligned with the elongated opening 115 of the inside opening lever 110, while the other section is substantially arc-shaped, centered on the axis of articulation 118*a* of the intermediate opening lever 118. The intermediate opening lever 118 and the inside opening lever 110 are articulated coaxially. The intermediate opening lever 118 includes a section 118*b* which is intended to cooperate with the tab 39*c* of the transfer lever 39 of the first module Ml. In this case, the spring 101 acts as an elastic return spring for the intermediate opening lever 118.

As seen more clearly in FIG. 19, the intermediate opening pin 116 also engages in the groove 107 of the child lock lever 104, towards the intermediate opening lever 118.

Figure 18:
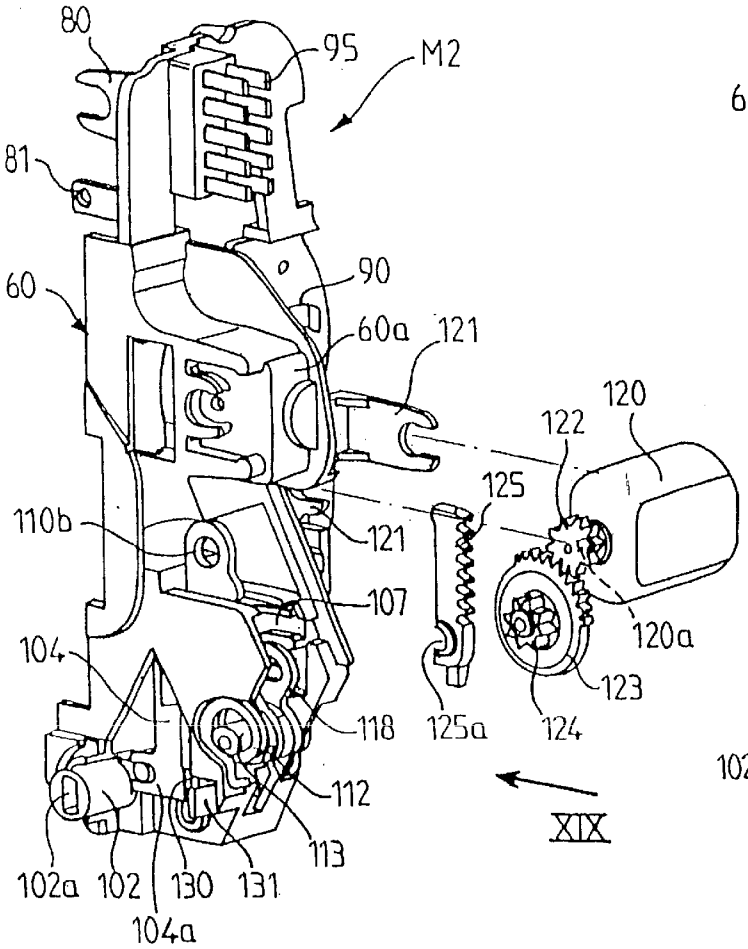
FIG. 18 is a view similar to FIG. 17, with electric child lock control parts exploded.

In the variant shown in FIGS. 18 and 19, the child-locking means can be controlled by an electric child-locking motor 120 mounted between two brackets 121 serving as support bearings for the body 60. The output shaft 120*a* of the motor 120 is rotationally attached to a pinion 122 which engages a cog 123 coaxially attached to a cog 124 of smaller diameter, this assembly thereby constituting a reducing gear. The cog 124 engages a rack 125 free to translate and including a notch 125*a* which engages the lug 104*c* of the child lock lever 104. The body 60 of the module M2 can be equipped with a contactor 126 cooperating with the rack 125, as a means of detecting the locked position of the child lock.

The operation of the child-locking means will now be described.

Figure 15:
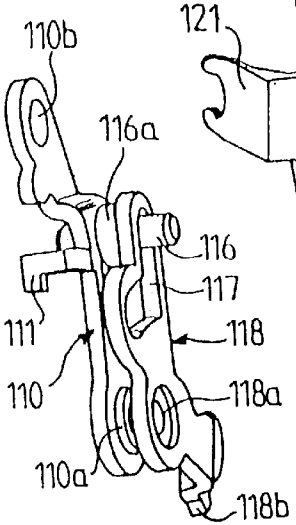
FIG. 15 is a view similar to FIG. 14, but with the parts in assembled position.
Figure 14:
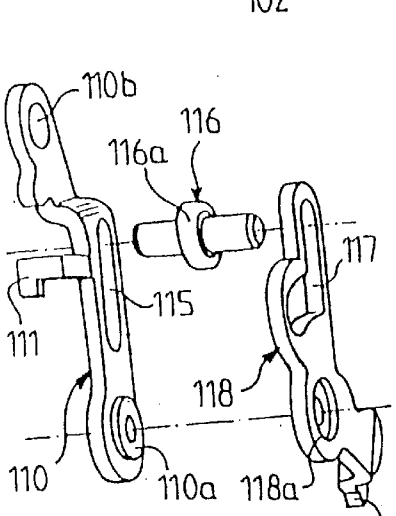
FIG. 14 is an exploded perspective view of the inside opening parts for a rear door lock.

In the inactive position of the child-locking means, the intermediate opening pin 116 is positioned by the child lock lever 104 in the position shown in FIG. 15. In this position, the inside opening lever 110 and the intermediate opening lever 118 are rotationally linked by the pin 116 which is engaged in the radial section of the opening 117. Therefore, when the inside opening lever 110 is raised, the intermediate opening lever 118 is rotated by the pin 116 so that the section 118*b* makes contact with the tab 39*c* of the transfer lever 39, which then also rotates on the spindle 17 of the first module M1. During the opening travel of the inside opening lever 110, the intermediate opening pin 116 can slide freely in the groove 107 of the child lock lever 104. When the lock is unlocked, the pivoting of the transfer lever 39 causes rotation, via the stud 50*b* of the interconnecting link 50, of the opening control lever 37 which acts by its section 37*a* on the pin 30 of the pawl 16 which rotates until its position in which the latch-bolt 14 is released. On the other hand, when the lock is locked, the pivoting of the transfer lever 39 does not cause rotation of the opening control lever 37, since the stud 50*b* of the interconnecting link 50 is opposite the arc-shaped section of the L-shaped opening 39*b* in the transfer lever 39; consequently the opening travel of the transfer lever 39 does not interfere with said stud 50*b*.

To put the lock in child-locked position, the motor 120 is started so that the rack 125 drives the lug 104*c* of the child lock lever 104. Alternatively, when the door is open, the user can introduce his key into the slot 102*a* of the knob 102 to turn this knob, which causes this same translation of the child lock lever 104.

The effect of the translation of the child lock lever 104 is to move the intermediate opening pin 116, via the groove 107, until this pin 116 reaches the other section of the L-shaped opening 117 in the intermediate opening lever 118. From this point on, during movement of the inside opening lever 110, the intermediate opening pin 116 is pushed by the control lever 110, but it slides freely in the arc-shaped section of the opening 117 without rotating the intermediate opening lever 118. In this manner, a decoupling is achieved between the inside opening lever 110 and the lock's kinematic opening chain. The opening travel of the inside opening lever 110 does not have any effect on the child lock lever 104, because the pin 116 can freely slide in the groove 107.

As seen more clearly in FIG. 18, the child lock lever 104 includes a boss 130 which cooperates with a flexible lever 131 of the body 60, so as to define two stable positions for the child lock lever, when the boss 130 contacts elastically the lever 131.

The casing C will now be described with reference to FIGS. 20 and 21. The casing C includes three orifices 140 for the sheaths of electric cables to be connected to the various contactors and motors of the lock. Another orifice 141 is provided to allow access to the pins 95 of the motor 42.

The modules M1 and M2 and the casing C are assembled by means of the two pins or shouldered screws 5, of which one traverses the spindles 113 and 114 of the second module M2 and serves as an axis of articulation either for the inside opening lever 100, or for the inside opening lever 110 and the intermediate opening lever 118. The other pin or shouldered screw 5 traverses the end 76*b* of the inside locking lever 76 to serve as its axis of articulation.

An advantageous characteristic of the invention is that all the parts of the lock are fitted on the various modules by simple clipping or crimping, without the use of fastening screws. In particular, the second module M2 is compact and the conducting tracks of the contactors are molded on the body 60. On the first module M1, the case 1 can be positioned to overlap the upper edge of the metal backplate 2, in which case a gutter is provide above the overlapped section of the case 1. This gutter is slightly inclined towards the inside of the door and serves to evacuate water infiltrating around the edge of the door.

The operation of the "anti-panic" means of the lock according to the invention will now be described in detail with reference to FIGS. 22 to 26.

Figure 22:
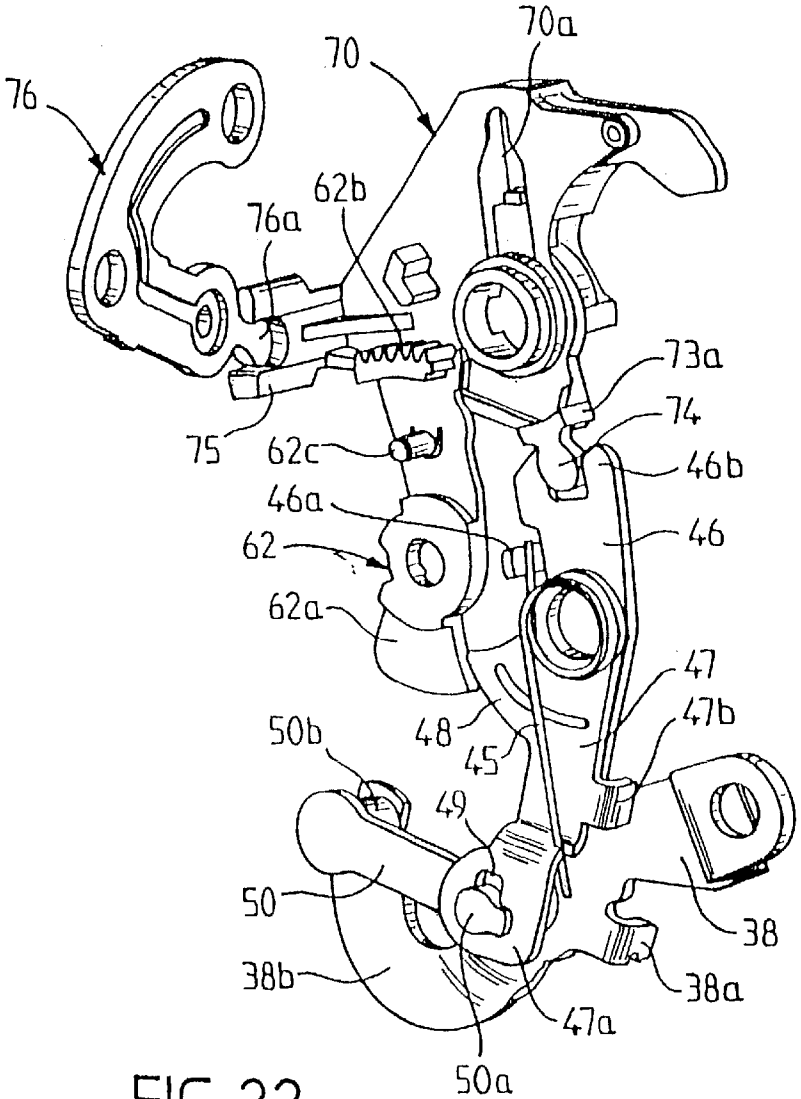
FIG. 22 is a perspective view of the kinematic chain of the anti-panic means of the lock according to the invention, in its unlocked state, with the outside opening lever in its rest position.

FIG. 22 shows the lock in its unlocked state, with the outside opening lever 38 at rest. In this case, stud 50*b* of the interconnecting link 50 is located opposite the free end of the curved section 38*b* of the outside opening lever 38. When the outside opening lever 38 is activated, the curved section 38*b* comes into contact with the stud 50*b* of the interconnecting link 50 to make it rotate around the stud 50*a*, which causes opening of the lock via the opening control lever 37. We notice in FIG. 22 that the section in the form of angular sector 48 blocks, in the unlocked state, the pivoting of the superlocking lever 62. In other words, superlocking is possible only when the lock is in its locked state.

Figure 23:
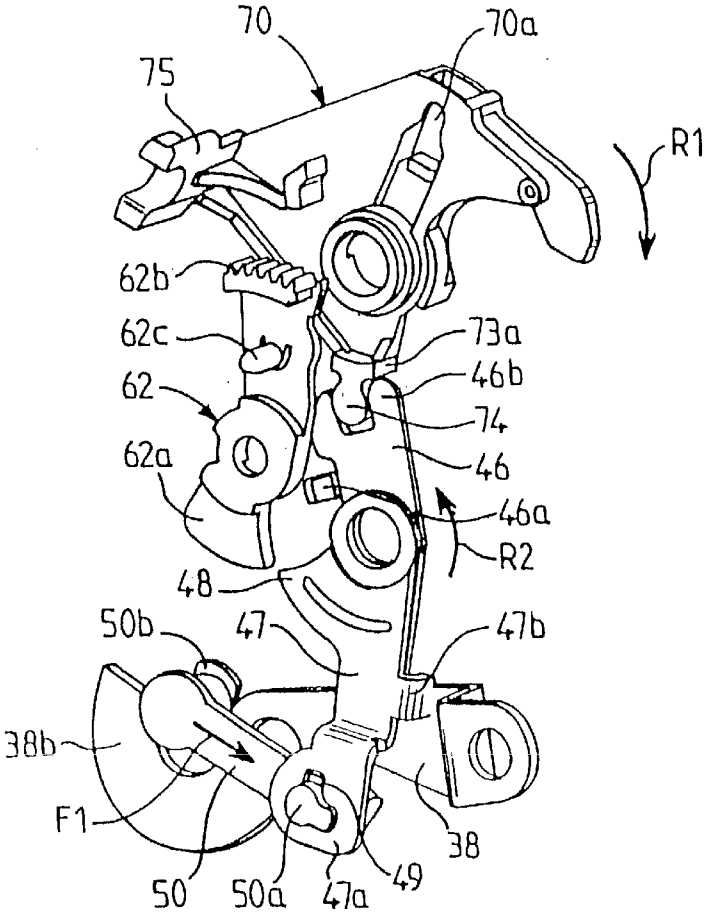
FIG. 23 is a view similar to FIG. 22, with the lock in its locked state.

To lock the lock, the central locking lever 70 must pivot clockwise, as indicated by the arrow R1, either via the inside locking lever 76 or the outside locking lever 68, or by the action of the electric locking control motor 42. Rotation of the central locking lever 70 causes, via its nipple 74, anti-clockwise pivoting (see arrow R2) of the first locking actuator 46. The second locking actuator 47 is also rotated anti-clockwise under the action of the elastic connecting spring 45. Pivoting of the second locking actuator 47 causes translation (in the direction of the arrow F1) of the interconnecting link 50, which then slides along the elongated opening 37*b* of the opening control lever 37 and in the opening 39*b* of the transfer lever 39. Simultaneously, stud 50*b* of the interconnecting link 50 arrives opposite the opening in the U-shaped section 38*b* of the outside opening lever 38, as seen in FIG. 23. In this position, during pivoting of the outside opening lever 38, the stud 50*b* of the interconnecting link 50 engages freely in the opening in the section 38*b*, thus preventing opening from the outside. In a similar manner, opening from the inside is also forbidden, since the rotation of the transfer lever 39 does not cause rotation of the stud 50*b* which can slide freely in the arc-shaped section of the L-shaped opening 39*b*.

Figure 24:
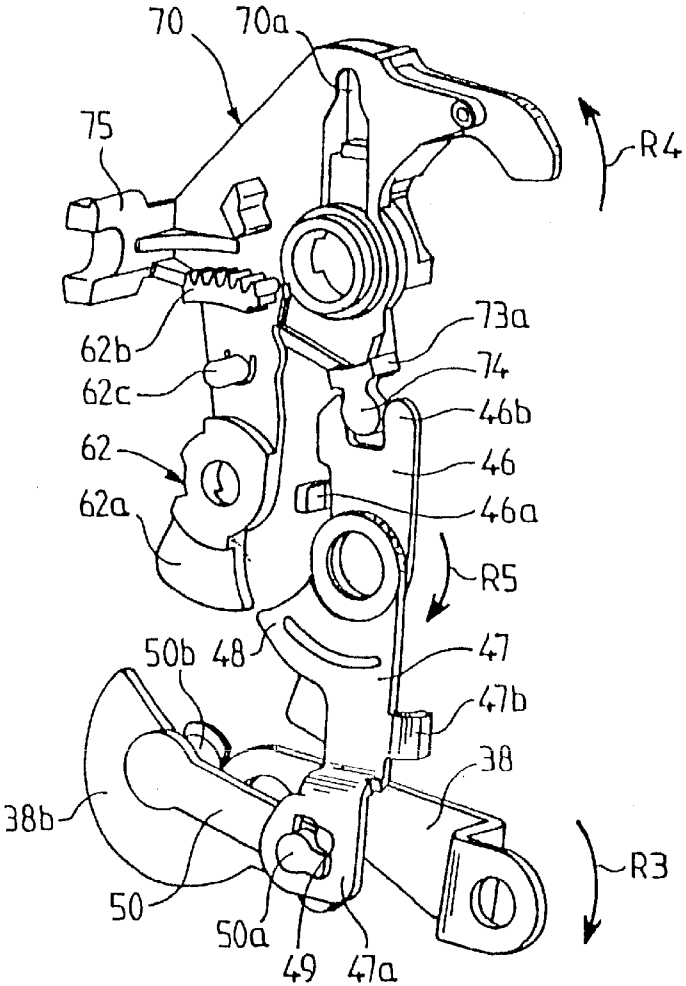
FIG. 24 is a view similar to FIG. 23, representing an unlocking action after the outside opening lever has reached the end of its opening travel.

In FIG. 24 we see a lock in which the outside opening lever 38 has been moved clockwise (arrow R3) and is held in its position at the end of its opening travel. In this configuration, the unlocking command of the lock intervenes after the end of the opening travel by the outside opening lever 38. The central locking lever 70 having rotated anti-clockwise (arrow R4), the first locking actuator 46 pivots clockwise (arrow R5). However, the second locking actuator 47 cannot rotate because the translation of the interconnecting link 50 is blocked by its stud 50*b* which is engaged in the opening in the U-shaped curved section 38*b* of the outside opening lever 38 at its end-of-travel position. The relative rotation of the first locking actuator 46 relative to the second locking actuator 47 causes elastic deformation of the spring 45, which thereby stores the unlocking energy. When the user releases the outside door handle, the outside opening lever returns to its initial position, which frees the stud 50*b* of the interconnecting link 50. Then, under the action of the spring 45, the second locking actuator 47 also rotates in the anti-clockwise direction, which causes a translation of the interconnecting link 50 until the stud 50*b* finds itself opposite the free end of the curved section 38*b* of the outside opening lever 38. Therefore a second activation of the outside door handle enables opening of the lock, without having to unlock the lock again.

Figure 25:
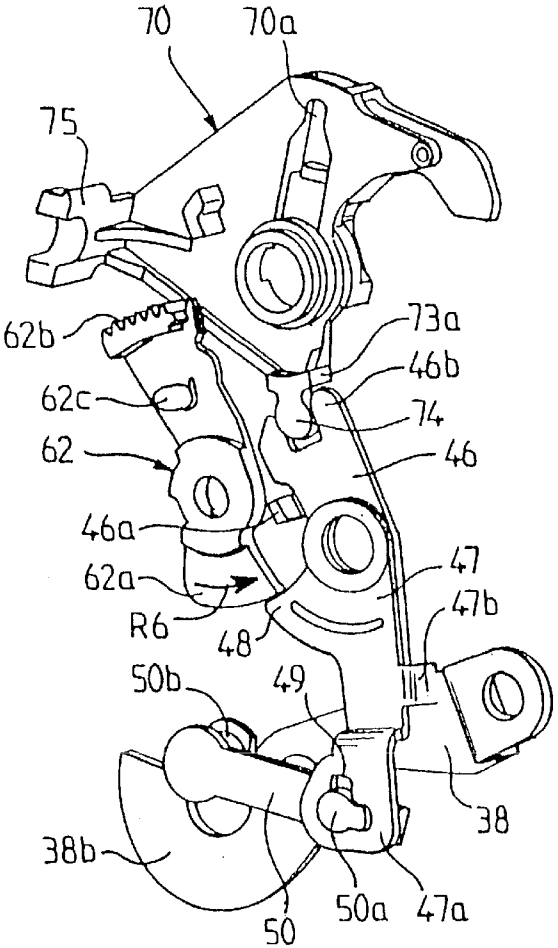
FIG. 25 is a view similar to FIG. 23, with the superlocking lever in superlocked position.

To pass from FIG. 23 to FIG. 25, the superlocking motor 66 has been started to rotate the superlocking lever 62 anti-clockwise (arrow R6) until its section 62*a* finds itself opposite a lateral edge of the section 48 in the form of an angular sector of the second locking actuator 47.

Figure 26:
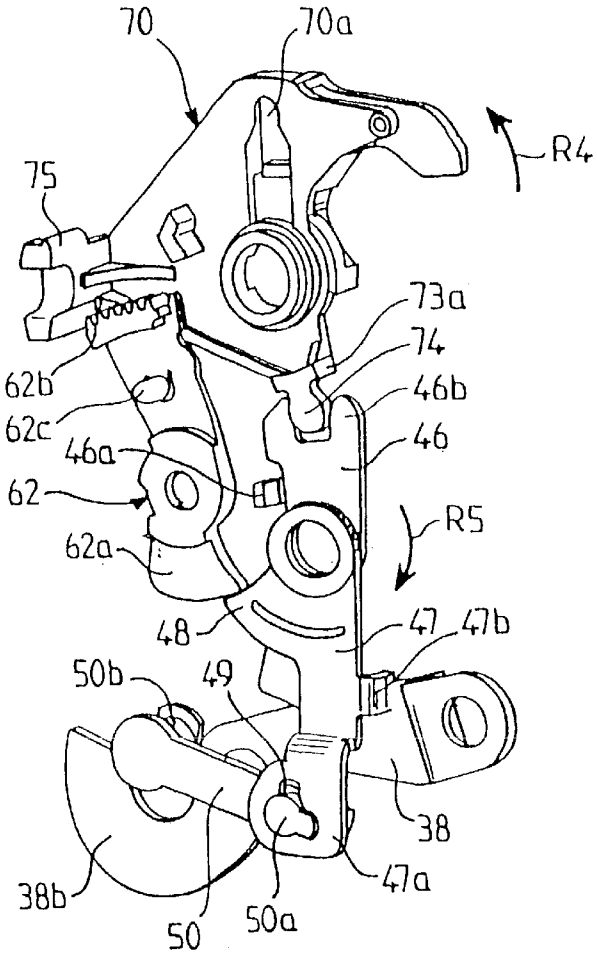
FIG. 26 is a view similar to FIG. 25, after an unlocking action.

In the event of attempted unauthorized entry, for example by pulling on the fascia pullrod to unlock the lock, the central locking lever 70 rotates in the direction of the arrow R4 in FIG. 26, which causes clockwise pivoting (arrow R5) of the first locking actuator 46. However, the second locking actuator 47 cannot rotate because it is blocked by the section 62*a* of the superlocking lever 62. The spring 45 stores, in a similar manner as described previously, the unlocking energy generated by the unlocking in the opposite direction to override the superlocking, the second locking actuator 47 rotates automatically anti-clockwise to unlock the lock, without having to unlock it again. The same effect is obtained when the central locking lever 70 pivots towards its unlocked position under the action of the electric motor 42. On the other hand, when the lock is unlocked using the lock barrel, the superlocking lever 62 is simultaneously returned to its rest position via the tab 68*b* of the outside locking lever 68, which cooperates with the stud 62*c* of the superlocking lever 62.

Although the invention has been described with reference to several particular embodiments, it will be obvious to professionals of the art that it is in no way limited to these examples, and that the use of technical equivalents of the various means, and their combinations, remain within the scope of the invention.

What is claimed is:

1. A motor vehicle door lock comprising a first module having a retention compartment containing a striker-retaining latch-bolt and a pawl that holds said latch-bolt in at least one position restraining the striker, and in which a first part of a kinematic opening/locking chain of the lock is mounted on a mounting face of said first module, on a side opposite from said retention compartment; and a second module on which is mounted another part of the kinematic opening/locking chain of the lock, said second module fitting on said first module on the same side as said mounting face; and a casing that covers said second module and the entire mounting face of said first module, said first and second modules and said casing being assembled by connectors.

2. A lock according to claim 1, wherein said second module has a body portion and wherein said connectors comprise at least two fasteners that traverse successively a metal backplate of said first module, the body portion of said second module and said casing.

3. A lock according to claim 2, wherein one of said fasteners serves as an axis of articulation for an inside locking lever fitted on said second module.

4. A lock according to claim 2, herein one of said fasteners serves as an axis of articulation for an inside opening lever on said second module.

5. A lock according to claim 1, wherein said first module includes a plastic case and a metal backplate which together define said retention compartment, said mounting face of said first module being defined by a bottom face of said case, on a side opposite from said retention compartment.

6. A lock according to claim 1, wherein on said second module are fitted an inside opening lever connected to an inside opening control member, a central locking lever, an inside locking lever that cooperates with said central locking lever, and an electric locking motor cooperating via a first gear train with said central locking lever.

7. A lock according to claim 6, wherein for a front door lock said second module also includes an outside locking lever cooperating with said central locking lever and connected to a lock barrel.

8. A lock according to claim 6, wherein on said second module are also fitted a superlocking lever and an electric superlocking motor cooperating, via a second gear train, with said superlocking lever.

9. A lock according to claim 6, wherein said second module also includes child-locking means cooperating with said inside opening lever, and an electric child-lock motor cooperating, via a third gear train, with said child-locking means.

10. A lock according to claim 6, wherein said first gear train of the electric locking motor includes a worm on which is screwed a nut with two drive ears and a guide finger, said nut being able to translate to move said central locking lever through the action of one of said drive ears, following the travel of the nut in the locking or unlocking direction, said guide finger constituting a cam follower that is guided in a cam groove on said mounting face of said first module, to turn over said nut from one drive ear to the other at the end of the locking or unlocking travel.

11. A lock according to claim 1, wherein on said mounting face of said first module are fitted an outside opening lever connected to an outside control member, an opening control lever that cooperates with said pawl, a transfer lever that cooperates with an inside opening lever mounted on said second module, a disengageable interconnecting link that in its engaged position can rotationally connect together said outside opening lever, said transfer lever and said opening lever, whereas in its disengaged position the opening travels of said outside opening lever and of said transfer lever do not interfere with said interconnecting link.

12. A lock according to claim 11, wherein on said mounting face of the first module are fitted anti-panic means including two distinct locking actuators whose respective movements are connected by elastic interconnection means, the first locking actuator cooperating with a central locking lever of the second module, and the second locking actuator being connected to said locking to said interconnecting link, such that on the one hand the movement of said central locking lever, when said outside opening lever is at rest, causes movement of said interconnecting link via said two locking actuators, and on the other hand the movement of said central locking lever to its unlocked position, when said outside opening lever is at the end of its opening travel, causes both movement of the first locking actuator and elastic deformation of said elastic interconnection means, the movement of said second locking actuator being blocked by said outside opening lever via said interconnecting link, the return of said outside opening lever to its rest position releasing said interconnecting link which then moves to its disengaged position under the action of said second locking actuator, which moves under the elastic action of said elastic interconnection means.

13. A lock according to claim 1, wherein said first module includes in its said retention compartment a feeler that cooperates with a profile of said latch-bolt to indicate at least its open position and its closed position, said feeler being rotationally attached to a contact part mounted on said mounting face.

14. A lock according to claim 13, wherein said second module includes at least one contactor that cooperates with said contact part which traverses an arc-shaped guide slot penetrating the body portion of said second module.

15. A lock according to claim 14, wherein said contact part includes at least one prong presenting an inclined ramp able to depress a push-button of said contactor during rotation of said feeler under the action of the pivoting of the latch-bolt between a position restraining the striker and a position releasing the striker.

* * * * *